US008350456B2

(12) United States Patent
Below

(10) Patent No.: US 8,350,456 B2
(45) Date of Patent: Jan. 8, 2013

(54) COLD FOUL RESISTANT SPARK PLUG

(75) Inventor: Matthew B. Below, Findlay, OH (US)

(73) Assignee: FRAM Group IP LLC, Lake Forest, IL (US)

( * ) Notice: Subject to any disclaimer, the term of this patent is extended or adjusted under 35 U.S.C. 154(b) by 0 days.

(21) Appl. No.: 12/361,126

(22) Filed: Jan. 28, 2009

(65) Prior Publication Data

US 2009/0189506 A1 Jul. 30, 2009

Related U.S. Application Data

(60) Provisional application No. 61/024,042, filed on Jan. 28, 2008.

(51) Int. Cl.
*H01T 13/20* (2006.01)

(52) U.S. Cl. ..... 313/143; 313/141; 123/169 R

(58) Field of Classification Search ..... 313/141, 313/143; 123/169
See application file for complete search history.

(56) References Cited

U.S. PATENT DOCUMENTS

| | | | | |
|---|---|---|---|---|
| 4,539,503 | A | 9/1985 | Esper et al. | |
| 5,091,672 | A | 2/1992 | Below | |
| 5,697,334 | A | 12/1997 | Below | |
| 5,873,338 | A | 2/1999 | Matsubara et al. | |
| 5,918,571 | A | 7/1999 | Below | |
| 6,104,130 | A | 8/2000 | Below | |
| 6,566,793 | B2 | 5/2003 | Honda et al. | |
| 7,122,948 | B2 | 10/2006 | Kanao et al. | |
| 7,282,844 | B2 * | 10/2007 | Kanao et al. | 313/141 |
| 2002/0024160 | A1 * | 2/2002 | Sugimoto | 264/12 |
| 2003/0085643 | A1 | 5/2003 | Matsubara | |
| 2006/0055297 | A1 * | 3/2006 | Koyama et al. | 313/141 |
| 2007/0252501 | A1 * | 11/2007 | Tinwell | 313/130 |

FOREIGN PATENT DOCUMENTS

| | | | |
|---|---|---|---|
| JP | 9330782 | A | 12/1997 |
| JP | 2005116513 | A | 4/2005 |

OTHER PUBLICATIONS

International Search Report—PCT/US2009/032234 dated Sep. 9, 2009.
Written Opinion of the International Searching Authority—PCT/US2009/032234 dated Sep. 7, 2009.

* cited by examiner

*Primary Examiner* — Anne Hines
*Assistant Examiner* — Jacob R Stern
(74) *Attorney, Agent, or Firm* — Barnes & Thornburg LLP; Erin J. Fox

(57) ABSTRACT

A spark plug is provided providing resistance to fouling. The spark plug includes a metal shell having a first end, a second end and an intermediate portion that collectively define a central cavity. The spark plug also includes an insulator that extends through the central cavity of the metal shell. The insulator includes a first end portion extending through an intermediate portion to a stepped tip portion having a first length. The stepped tip portion includes a first section and a substantially straight second section having a second length. The substantially straight second section includes a segment that extends beyond the second end of the metal shell to a third length. The second length of substantially straight portion is based upon at least one of the first length and the third length.

11 Claims, 2 Drawing Sheets

COLD FOUL RESISTANT SPARK PLUG

CROSS REFERENCE TO RELATED APPLICATION

This application claims the benefit of the following U.S. Provisional Patent application Ser. No. 61/024,042 filed Jan. 28, 2008, the contents of which are incorporated herein by reference thereto.

BACKGROUND OF THE INVENTION

Exemplary embodiments of the present invention related to spark plugs and, more particularly, to spark plugs having a ceramic tip configured to resist cold fouling.

In general, spark plugs include an insulative sleeve having a central axial bore through which a center electrode extends. The insulating sleeve is positioned within, and secured to, a metal shell that serves as a mounting platform and interface to an internal combustion engine. The metal sleeve also supports a ground electrode that is positioned in a particular spaced relationship relative to the center electrode so as to generate a spark gap. The insulating sleeve includes a shaped tip portion that resides in a recessed end portion of the metal shell. The shaped tip portion is configured to protect the electrode from engine heat and products of combustion. The spark plug is typically mounted to an engine cylinder head and selectively activated to ignite a fuel/air mixture in an associated engine cylinder.

Over time, products of combustion or combustion deposits build up around the center electrode and particularly the shaped tip portion. This build up of combustion product inhibits spark formation across the spark gap. A significant build up of combustion products may foul the spark plug and resulting in ignition failure, i.e., the combustion products completely block the spark from forming between the center and ground electrodes. Combustion deposit build up is particularly problematic during cold starts. During cold starts, complete combustion of the air/fuel mixture is seldom achieved which results in an increased generation of combustion product. As a result of continuous cold starts, combustion product builds up on the center and ground electrodes causing spark plug to become fouled, thereby preventing or weakening the formation of a spark across the spark gap.

BRIEF DESCRIPTION OF THE INVENTION

In accordance with one exemplary embodiment, a spark plug is provided including a metal shell having a first end, a second end and an intermediate portion that collectively define a central cavity. In addition, the spark further includes an insulator that extends through the central cavity of the metal shell. The insulator includes a first end portion extending through the intermediate portion of the metal shell to a stepped tip portion having a first length. The stepped tip portion includes a first section, and a substantially straight second section having a second length. The substantially straight section includes a segment that extends beyond the second end of the metal shell to a third length. The second length is based upon at least one of the first length and the third length.

The above described spark plug configuration has been advantageously found to resist cold start fouling. The length proportion of the substantially straight section of the tip relative to the overall length of the stepped tip and/or the length of the substantially straight section of the tip extending beyond the second end of the metal shell inhibits build up of combustion products that would otherwise inhibit spark development. In addition, it has been found that the particular length proportion allows rapid combustion product "burn off" while still providing necessary mechanical and thermal electrode protection. Additional objects, features and advantages of the present invention will become more readily apparent from the following detailed description when taken in conjunction with the drawings wherein like reference numerals refer to corresponding parts in the several views.

DETAILED DESCRIPTION OF THE INVENTION

Figure 1:
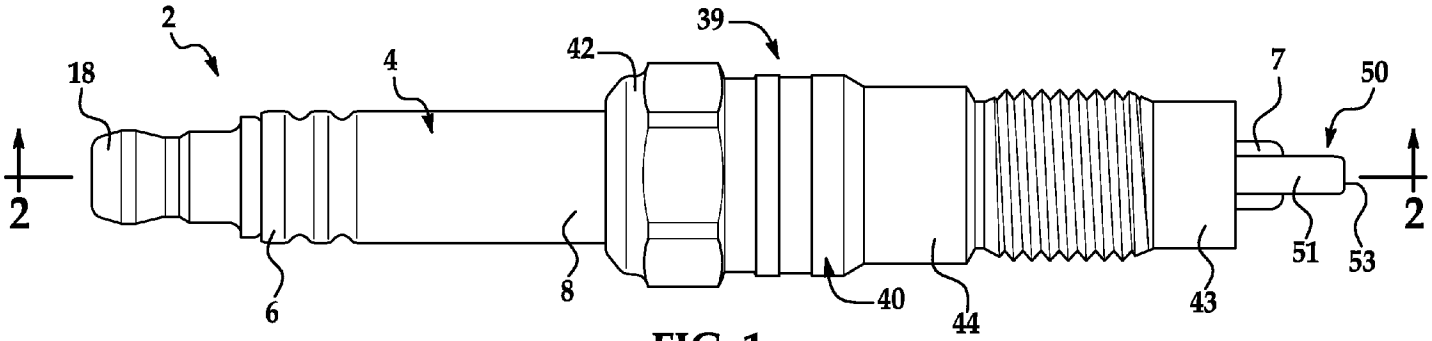
FIG. 1 is an elevational view of an exemplary embodiment of a spark plug.
Figure 2:
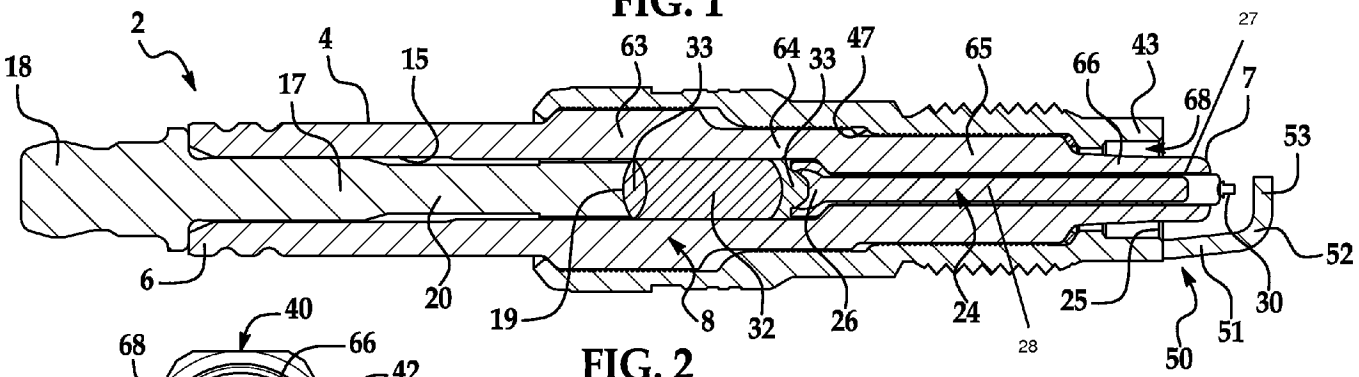
FIG. 2 is a cross-sectional view along lines 2-2 of FIG. 1.
Figure 3:
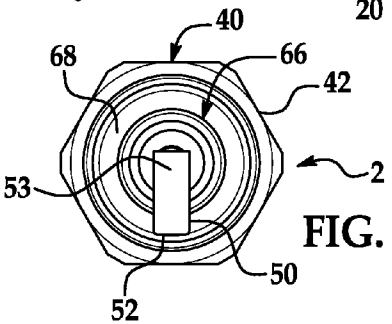
FIG. 3 is an end view of the spark plug of FIG. 2.

Reference is also made to U.S. provisional patent application Ser. No. 61/024,045 filed Jan. 28, 2008 and U.S. patent application Ser. No. 12/361,028, filed Jan. 28, 2009, the contents each of which are incorporated herein by reference thereto. With initial reference to FIGS. 1-3, an exemplary embodiment of a spark plug 2 is shown. The spark plug 2 includes an electrically insulating sleeve or insulator 4 having a first end portion 6, a second end portion 7 and an intermediate portion 8. Insulator 4 includes an axial bore 15 that extends between first and second end portions 6 and 7. As best shown in FIG. 2, spark plug 2 includes a first electrode 17 arranged in an upper portion (not separately labeled) of axial bore 15. First electrode 17 includes a first end or tip section 18 located outside and beyond first end portion 6 and a second end section 19 located within and at a first ending of axial bore 15. The first and second end section are joined together through intermediate section 20.

The spark plug 2 also includes a second electrode 24 located within and at a second end of axial bore 15. The second electrode 24 includes a first end section 26 and a second end section 27. The first and second end sections being joined together through an intermediate section 28. Second electrode 24 includes a tip portion 30 provided at second end section 27. First and second electrodes 17 and 24 are electrically connected through a resistor 32. In one embodiment, electrodes 17 and 24 are electrically connected to resistor 32 through a conductive glass 33 or equivalents thereof.

Insulator 4 extends, at least in part, into a metal sleeve or shell 39. Metal shell 39 includes a main body 40 having a first end 42, a second end 43 and an intermediate section 44 that collectively define an interior or central cavity 47. Metal shell 39 also includes a ground electrode 50. Ground electrode 50 includes a first segment 51 that extends from second end 43 of main body 40, a second or curved segment 52 and a third segment 53. Third segment 53 is spaced from, and extends generally perpendicular to tip portion 30 so as to define a spark gap 'G'.

Figure 4:
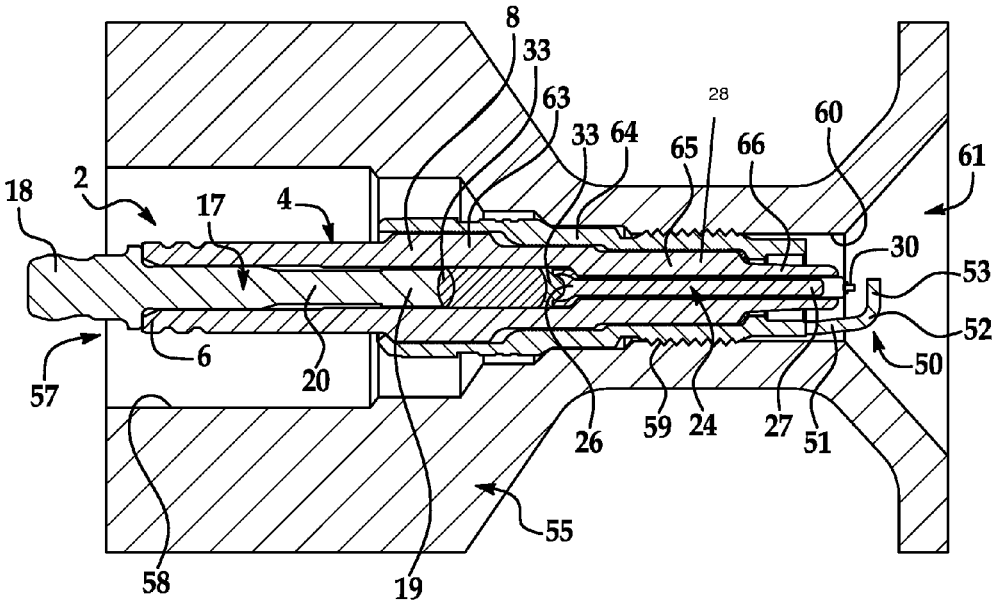
FIG. 4 is a cross-sectional view of an exemplary embodiment of a spark plug mounted to an internal combustion engine.

In a manner known in the art, metal shell 39 provides a robust mounting arrangement for securing spark plug 2 to an engine cylinder head 55. As best shown in FIG. 4, cylinder head 55 includes a spark plug receiving portion 57 having a first end portion 58, an intermediate portion 59 (a portion of which is threaded) and a second end portion 60. Second end portion 60 opens to a recessed area 61 that defines an upper portion of a combustion chamber.

In accordance with one exemplary embodiment of the present invention, intermediate portion 8 of insulator 4 is formed with a series of steps. More specifically, intermediate portion 8 includes a first stepped segment 63 that leads to a second stepped segment 64 which extends to a third stepped segment 65 and terminates in a fourth stepped segment or stepped tip portion 66. A portion of fourth stepped segment projects beyond second end 43 of metal shell 39. Stepped tip portion 66 is spaced from an interior wall portion (not separately labeled) of central cavity 47 so as to define a recess or cup portion 68.

In prior art arrangements, the cup portion would fill with combustion deposits and foul the spark plug. Combustion product build up is particularly prevalent during cold starts. During cold starts, air/fuel ratios are generally rich i.e., there is insufficient air for complete combustion of all the fuel. Over time, the unburned fuel builds up in the cup portion and inhibits a spark from passing across the spark gap.

In accordance with another exemplary embodiment of the present invention, stepped tip portion 66 includes a first section 69 that extends from third stepped segment 65 to a second substantially straight section 70. As will be discussed more fully below, the particular construction of substantially straight section 70 inhibits combustion products from building up within cup portion 68. In this manner, substantially straight portion 70 advantageously resists cold fouling.

Figure 5:
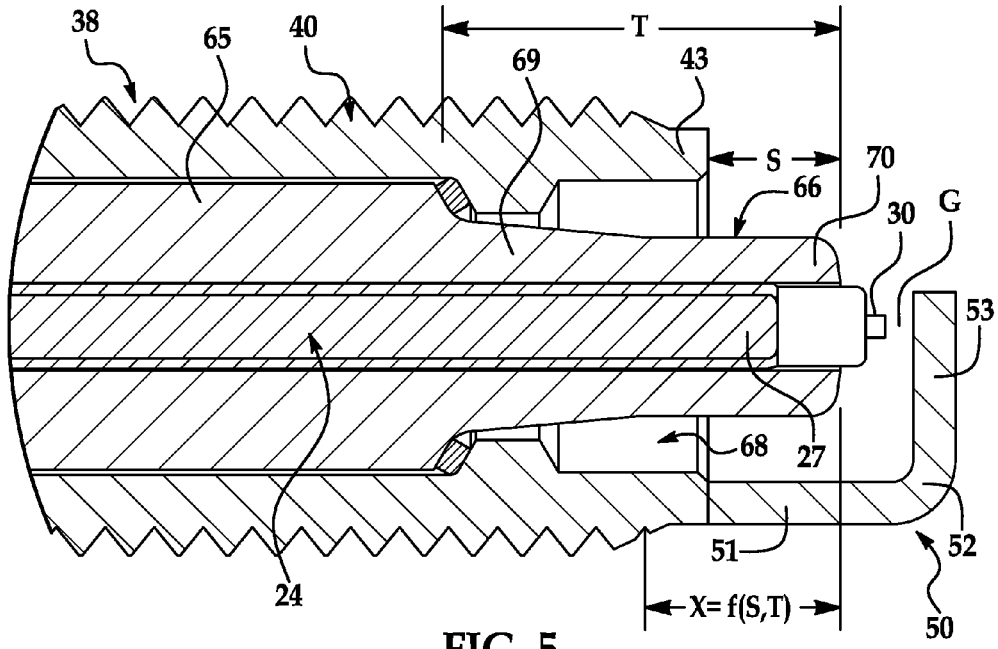
FIG. 5 is an enlarged cross-sectional view of an end portion of an exemplary embodiment of a spark plug.

As best shown in FIG. 5, stepped tip portion 66 includes an overall length "T" with substantially straight portion 70 having a length "X". As further shown, a portion of substantially straight portion 70 extends beyond second end 43 of metal shell 39 and has a length "S". Length "X" of substantially straight portion 70 is a function of overall length "T" and length "S". More specifically, in accordance with an exemplary embodiment of the present invention, the dimensional relationship between the different components of tip portion 66 can be expressed by:

$$X=C1*(T-S*C2)$$

Where:

0<=C1<1; and

0<=C2<=1.

When C1 is set at approximately 0.25 and C2 is established at about 1, "T" is preferably in a range of between approximately 0.050 and 1.000 inches (1.27-25.4 mm). More preferably, "T" is in a range of between approximately 0.500 and 0.900 inches (12.7-22.86 mm). Most preferably, "T" is in a range of between approximately 0.600 and 0.800 inches (15.24-20.32 mm). "S" is preferably in a range of between approximately 0.000 and 0.500 inches (0.000-12.7 mm). More preferably, "S" is in a range between approximately 0.100 and 0.200 inches (2.54-5.08 mm). Most preferably, "S" is in a range between approximately 0.130 and 0.140 inches (3.302-3.556 mm). It being understood that in one exemplary embodiment C1 and C2 are of course greater than zero.

It should be appreciated that the above expressed dimensional relationship and configuration of substantially straight portion 70 resists combustion deposit build up and cold fouling. The length proportions of stepped tip portion inhibits build up of combustion products that would otherwise inhibit spark development. In addition, it has been found that the length proportion of stepped tip portion 66 also allows rapid combustion product "burn off" while still providing necessary mechanical and thermal electrode protection.

It should be understood that although described with reference to exemplary embodiments of the present invention, it should be readily understood that various changes and/or modifications can be made to the exemplary embodiment without departing from the spirit thereof. For instance, the particular stepped arrangement of the intermediate portion of the insulating sleeve can be varied. In addition, the number and arrangement of the ground electrode could also be varied. Furthermore, the above described ranges should be understood to be associated with an exemplary embodiment of the invention and can vary without departing from the scope of the invention.

The invention claimed is:

1. A spark plug, comprising:

an outer metal shell, the outer metal shell having a distal end that defines a recessed opening;

a ground electrode tip extending from the distal end;

an insulator located within the outer metal shell, the insulator having a distal end extending past the distal end of the outer metal shell;

an electrode tip located on the distal end of the insulator, the electrode tip being located in a facing spaced relationship with regard to the ground electrode;

wherein the insulator has a substantially straight portion that extends from the distal end of the insulator into the recessed opening of the outer metal shell such that no portion of the substantially straight portion contacts the outer metal shell and a portion of the substantially straight portion extends into and out of the recessed opening;

wherein the insulator further comprises a tapered portion configured to increase the diameter of the insulator, the tapered portion being completely received within the outer metal shell and extends from the substantially straight portion;

wherein an overall length of the substantially straight portion (X) is a function of i) a portion of the substantially straight portion not located within the outer metal shell and extending from the distal end of the outer metal shell (S) and wherein X is defined by the following formula X=C1*(T−S*C2) and C1 is 0.25 and C2 is 1; and ii) a combined length (T) of the substantially straight portion and the tapered portion; and wherein T is in a range defined by a lower limit of approximately 0.050 inches and an upper limit of approximately 1.000 inches (1.27-25.4 mm) and wherein S is in a range defined by a lower limit of approximately 0.00 inches and an upper limit of approximately 0.200 inches (0.0-5.08 mm).

2. The spark plug according to claim 1, wherein T is in a range defined by a lower limit of approximately 0.500 inches and 0.900 inches (12.7-22.86 mm).

3. The spark plug according to claim 2, wherein T is in a range defined by a lower limit of approximately 0.600 inches and an upper limit of approximately 0.800 inches (15.24-20.32 mm).

4. The spark plug according to claim 1, wherein S is in a range defined by a lower limit of approximately 0.130 inches and an upper limit of approximately 0.140 inches (3.302-3.556 mm).

5. A cold foul resistant spark plug, comprising:

an outer metal shell having a first end and a second end;

an insulator disposed with the outer metal shell and having a first end and a second end each of which extends away from the outer metal shell, wherein the second end of the insulator and the second end of the metal shell are configured to be disposed within a combustion chamber of an engine;

wherein the second end of the insulator further comprises: a) a substantially straight section (X) having a uniform outer diameter and comprising: i) a portion received within the second end of the outer metal shell; and ii) another portion (S) extending from a distal end of the second end of the outer metal shell: and b) a tapered portion completely received within the outer metal shell, wherein the tapered portion gradually increases the outer diameter of the insulator and wherein the tapered portion and the substantially straight section (X) define a length (T) of the second end of the insulator, wherein X is a function of S and T and wherein X is defined by the following formula X=C1*(T−S*C2) and C1 is 0.25 and C2 is 1; and wherein T is in a range defined by a lower limit of approximately 0.050 inches and an upper limit of approximately 1.000 inches (1.27-25.4 mm).

6. The spark plug as in claim 5, wherein T is in a range defined by a lower limit of approximately 0.500 inches and 0.900 inches (12.7-22.86 mm).

7. The spark plug as in claim 6, wherein T is in a range defined by a lower limit of approximately 0.600 inches and an upper limit of approximately 0.800 inches (15.24-20.32 mm).

8. The spark plug as in claim 5, wherein S is in a range defined by a lower limit of approximately 0.00 inches and an upper limit of approximately 0.200inches (0.0-5.08 mm).

9. The spark plug as in claim 8, wherein S is in a range defined by a lower limit of approximately 0.130 inches and an upper limit of approximately 0.140 inches (3.302-3.556 mm).

10. The spark plug as in claim 5, wherein T is in a range defined by a lower limit of approximately 0.500 inches and an upper limit of approximately 0.900 inches (12.7-22.86 mm) and wherein S is in a range defined by a lower limit of approximately 0.100 inches and an upper limit of approximately 0.200 inches (2.54-5.08 mm).

11. The spark plug as in claim 5, wherein T is in a range defined by a lower limit of approximately 0.600 inches and an upper limit of approximately 0.800 inches (15.24-20.32 mm) and wherein S is in a range defined by a lower limit of approximately 0.130 inches and an upper limit of approximately 0.140 inches (3.302-3.556 mm).

* * * * *